US005144891A

United States Patent [19]

McKenna

[11] Patent Number: 5,144,891

[45] Date of Patent: Sep. 8, 1992

[54] WEB HANDLING METHOD AND APPARATUS

[75] Inventor: Thomas G. McKenna, Bellbrook, Ohio

[73] Assignee: Monarch Marking Systems, Inc., Dayton, Ohio

[21] Appl. No.: 694,523

[22] Filed: May 1, 1991

Related U.S. Application Data

[63] Continuation-in-part of Ser. No. 590,268, Sep. 28, 1990, Pat. No. 5,092,697.

[51] Int. Cl.[5] ..... B41F 13/56

[52] U.S. Cl. ..... 101/227; 400/621.1; 226/195; 225/2; 225/3; 225/32; 225/94; 225/97; 83/13; 83/425; 83/436

[58] Field of Search ..... 101/227, 226; 400/621, 400/621.1, 227; 226/195; 225/1, 2, 3, 7, 10, 14, 19-24, 27, 29, 31, 32, 33, 43, 77, 88, 91, 94, 96, 97, 99, 106, 37, 39, 46, 55, 67, 74, 89, 92-93, 95, 96.5, 98-100, 104, 105; 242/56 R, 56.1-56.8; 83/13, 27, 32, 44, 111-112, 162, 401, 425, 436

[56] References Cited

U.S. PATENT DOCUMENTS

| | | | |
|---|---|---|---|
| 150,874 | 5/1874 | Mayhall | 225/96 |
| 1,650,025 | 11/1927 | Mee et al. | 101/227 |
| 2,026,754 | 1/1936 | Stafford | 225/93 |
| 2,252,734 | 8/1941 | Sherman | 225/105 |
| 2,328,582 | 9/1943 | Ratchford et al. | 225/96 |
| 2,788,852 | 4/1957 | Sharpe | 225/24 |
| 2,970,784 | 2/1961 | Kessler | 225/100 |
| 4,423,975 | 1/1984 | Krenz | 400/621.1 |
| 4,601,692 | 7/1986 | Rausing et al. | 225/93 |
| 4,851,075 | 7/1989 | Parker | 225/93 |
| 4,940,347 | 7/1990 | Lund | 225/100 |

FOREIGN PATENT DOCUMENTS

| | | | |
|---|---|---|---|
| 716806 | 1/1942 | Fed. Rep. of Germany | 225/99 |
| 29172 | 10/1955 | Fed. Rep. of Germany | 225/7 |
| 3119998 | 12/1982 | Fed. Rep. of Germany | 400/621.1 |
| 2599298 | 12/1987 | France | 400/621.1 |
| 159004 | 2/1921 | United Kingdom | 101/227 |

*Primary Examiner*—Eugene H. Eickholt
*Attorney, Agent, or Firm*—Joseph J. Grass

[57] ABSTRACT

There is disclosed a web handling apparatus including a printer for printing on longitudinally extending multi-portion webs, with the web including a plurality of longitudinally extending web portions and connected at a longitudinal line of weakening between each adjacent pair of web portions, each web portion including record members, guide structure for causing adjacent web portions to move along different paths or planes to effect tearing and resultant separation of the web portions at each line of weakening, and a rewinder for drawing on the separated web portions and winding them into separate rolls. In the event tearing does not occur readily along the lines of weakening, there are knives to assist in separating the web portions.

20 Claims, 5 Drawing Sheets

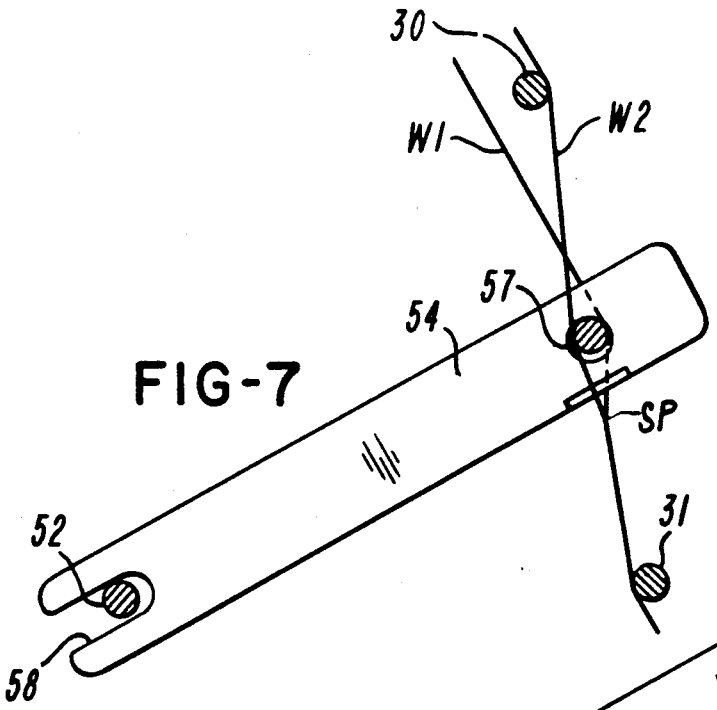
FIG-7
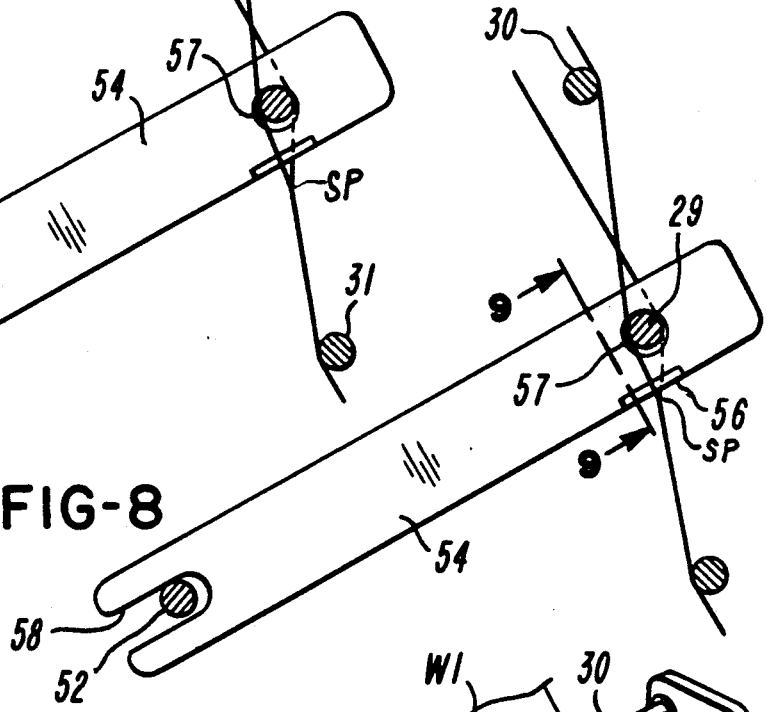
FIG-8
FIG-9
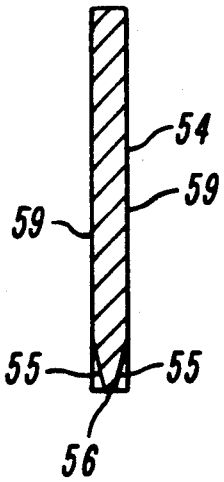
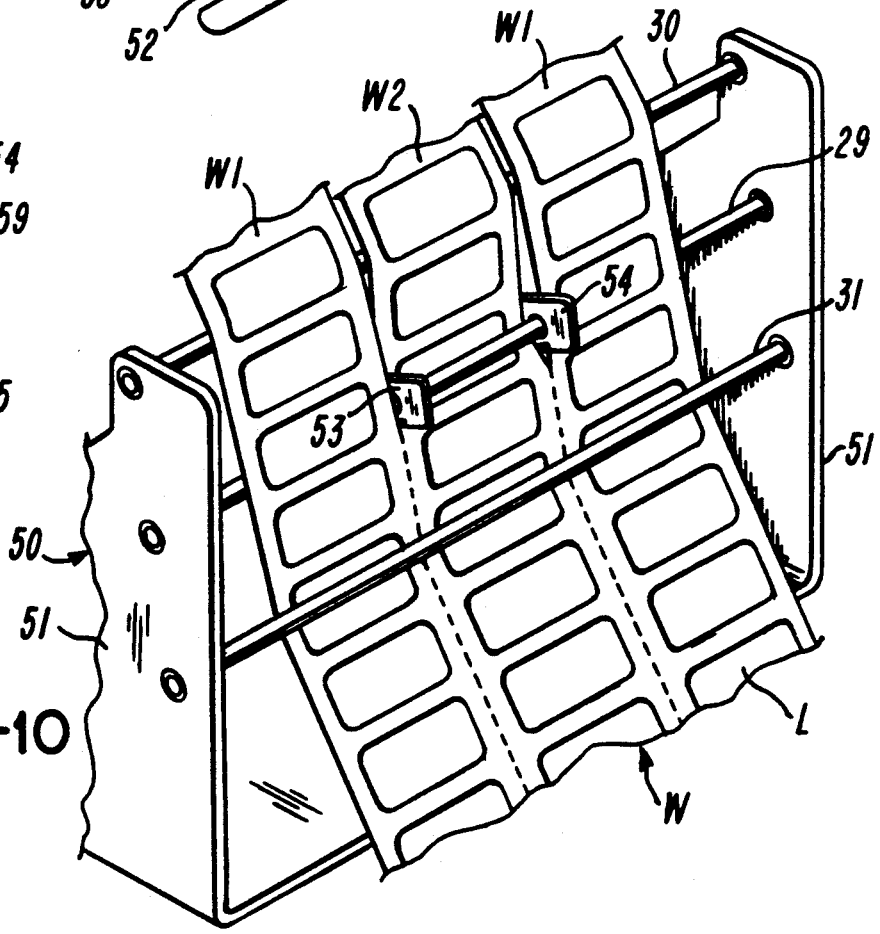
FIG-10

WEB HANDLING METHOD AND APPARATUS

CROSS-REFERENCE TO RELATED APPLICATION

This application is a continuation-in-part of application Ser. No. 07/590,268 filed Sep. 28, 1990, now U.S. Pat. No. 5,092,697.

BACKGROUND OF THE INVENTION

1. Field of the Invention

This invention relates to the art of web handling apparatus and methods of handling webs.

2. Brief Description of the Prior Art

U.S. Pat. No. 3,783,783 granted Jan. 8, 1974 to Paul H. Hamisch, Jr. is made of record.

It is a feature of the invention to increase the productivity of a printer by simultaneously printing transversely across a web having longitudinally extending lines of weakening, and tearing the web into web portions each having printed data, wherein the tearing is effected by passing the web portion in different paths about a guide.

It is another feature of the invention to provide improved, simple, low-cost method and apparatus for tearing a web into a plurality of web portions.

It is still another feature of the invention to provide improved method and apparatus for producing multiple rolls of custom-printed labels in an in-line arrangement using a single printer.

It is yet another feature of the invention to provide an improved simple, low-cost, easy to assemble, portable apparatus having relatively few parts for separating a wide web into a plurality of narrow webs or web portions.

It is also a feature of the invention to provide improved method and apparatus for assisting in separation of the web into web portions using a knife operative only when separation by tearing fails to occur readily.

It is another feature of the invention to provide method and apparatus in which a longitudinally extending multi-part web issuing from a source device is separated at laterally-spaced longitudinally extending lines of weakening by causing the web portion to follow different paths, wherein a knife for each adjacent pair of web portions is floatingly mounted for lateral movement so as to maintain alignment with the line of weakening in the web.

It is also a feature of the invention to provide for separation of a longitudinally extending multi-portion web at points along longitudinally extending lines of weakening by causing the web portion to follow different paths, wherein a knife received between opposed side edges of torn-apart, adjacent web portions assists in the separation. It is preferred that the knife is effective when the web portions fail to be readily torn apart, and most preferably only when the web portions fail to be readily torn apart.

BRIEF DESCRIPTION OF THE DRAWINGS

FIG. 7 is a sectional view showing the relation of a knife to the separation point between adjacent web portions;

FIG. 8 is a view similar to FIG. 7, but showing the coaction of the knife with the web when the web portions fail to tear apart at the separation point;

FIG. 9 is an enlarged sectional view taken generally along line 9—9 of FIG. 8; and FIG. 10 is a perspective view showing alternate threading of the web portions.

DESCRIPTION OF THE PREFERRED EMBODIMENT

Figure 1:
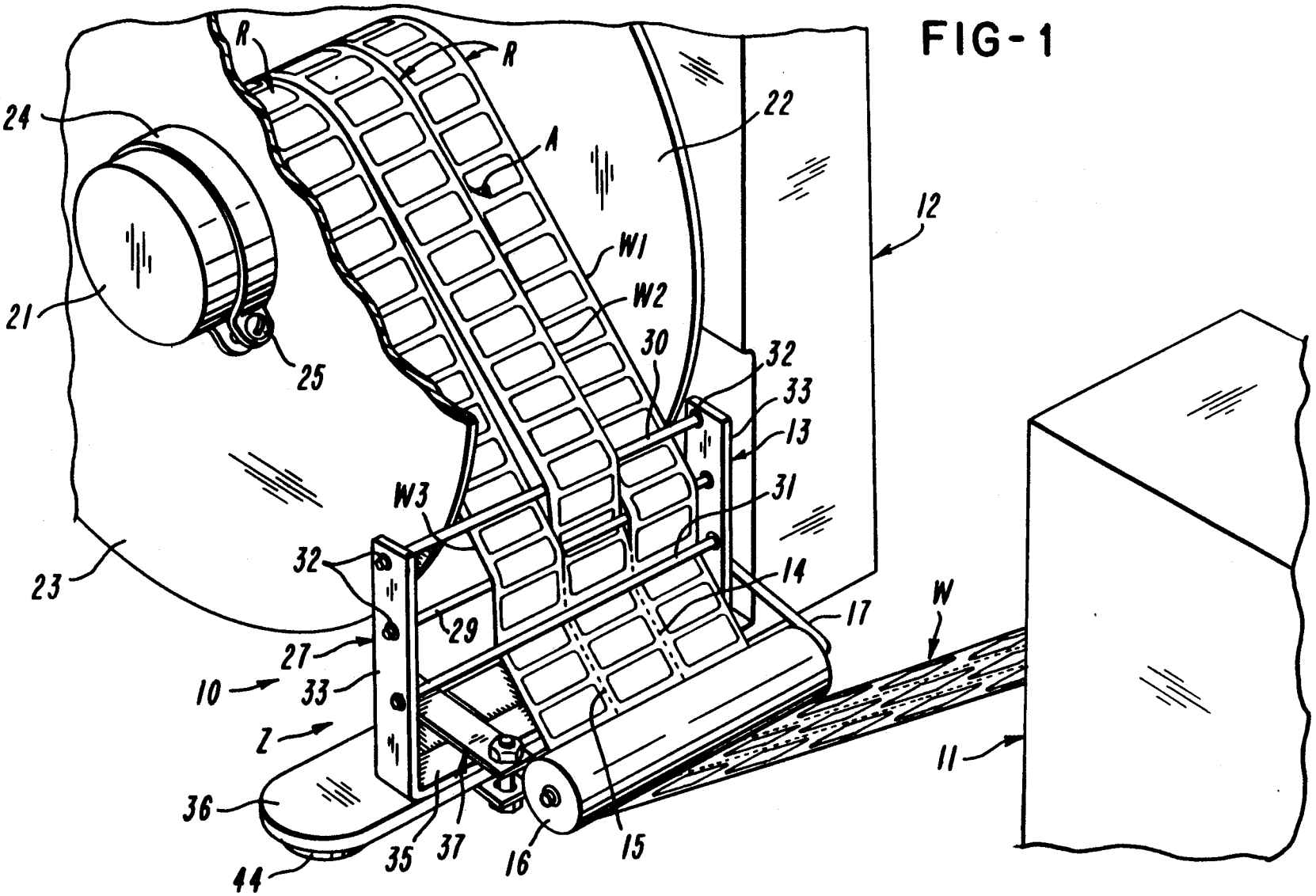
FIG. 1 is a perspective view of web handling apparatus of the invention.

Referring to FIG. 1, there is shown a web handling apparatus generally indicated 10. The apparatus 10 is shown to include a printer generally and diagrammatically indicated at 11, a rewinder generally indicated at 12, and a device 13 comprising guide structure for separating a multi-portion web W into web portions W1, W2 and W3. The printer 11 and the rewinder 12 are supported on a flat surface S of a table or portable cart. The longitudinally extending web W is shown passing downstream from the printer 11 with the longitudinally extending web portions W1, W2 and W3 in tact. The device 13 is located at a zone Z downstream of the printer 11 and upstream of the rewinder 12 in an in-line arrangement. The web portions W1 and W2 are connected to each other at a longitudinal line of weakening 14, and the web portions W2 and W3 are connected to each other at a longitudinal line of weakening 15. The web portions W1, W2 and W3 are shown to comprise composite label webs with carrier webs on release liners C1, C2 and C3 to which labels L are releasably secured by pressure sensitive adhesive A. The web portions W1, W2 and W3 could as well be comprised of tag web portions instead of composite pressure sensitive label web portions.

The printer 11 has a print head (not shown) which simultaneously prints data D on all the labels L in each transverse row across the web W. The data D can include bar codes, human readable numbers such as prices, and the like. While all the labels L are printed, only two transverse rows R1 and R2 are shown as having printing to prevent the drawings from being cluttered. The printer 11 can take the form of a printer disclosed in U.S. Pat. No. 4,776,714 granted to Sugiura et al on Oct. 11, 1988 incorporated herein by reference and sold by Monarch Marking Systems, In., Dayton, Ohio U.S.A. under its 9400® Series trademark.

The web W passes beneath and in contact with a dancer roll 16 which is part of the rewinder 12. The dancer roll 16 is rotatable mounted on a lever arm 17 for generally vertical movement. The dancer roll 17 senses slackness in the web W and descends as the web W becomes slack and is raised by the web W as tension in the web W increases. The rewinder 12 is sold by Monarch Marking Systems, Inc. under its trademark 415.

Figure 2:
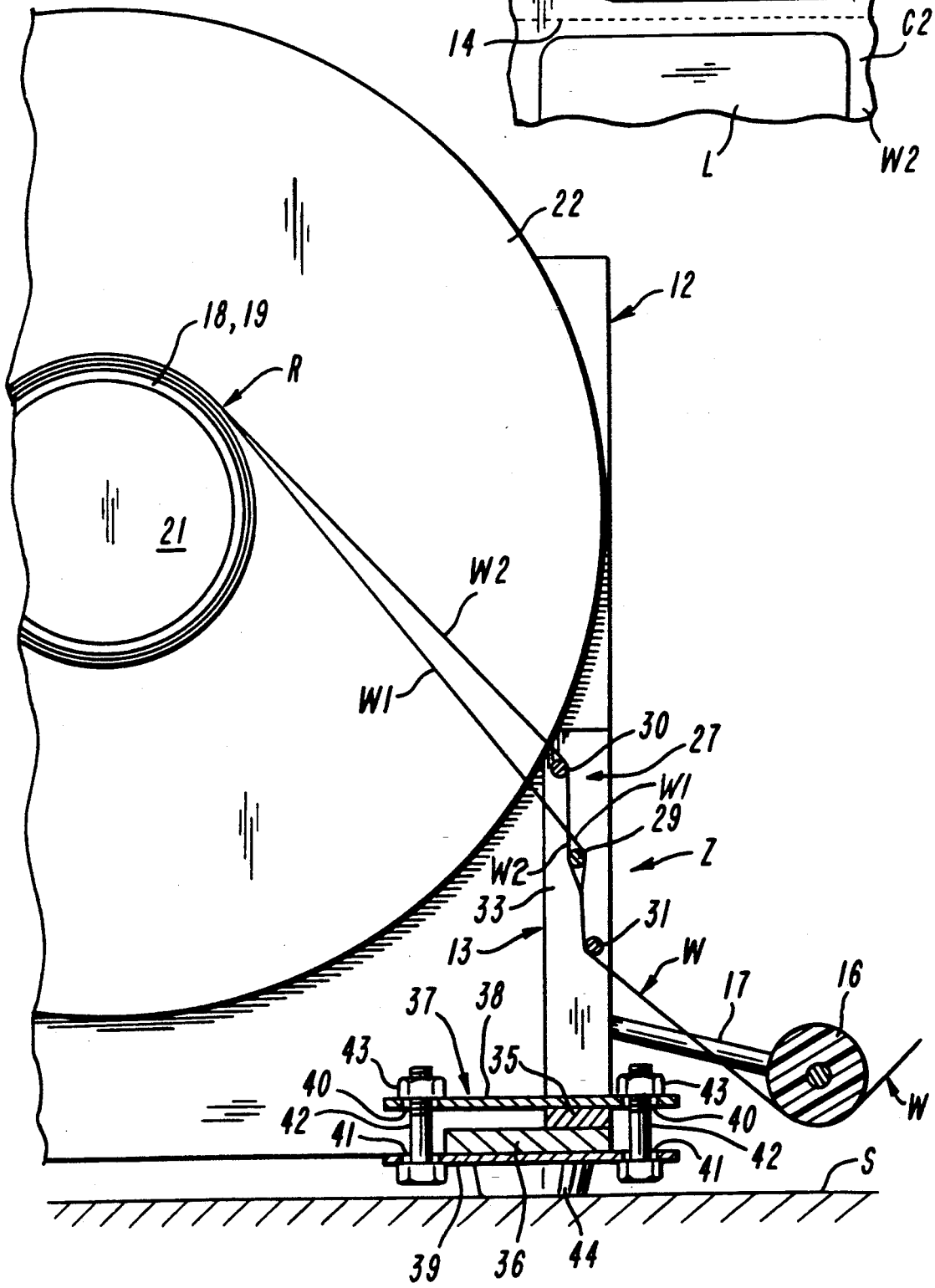
FIG. 2 is an elevational sectional view of a portion of the apparatus shown in FIG. 1.
Figure 3:
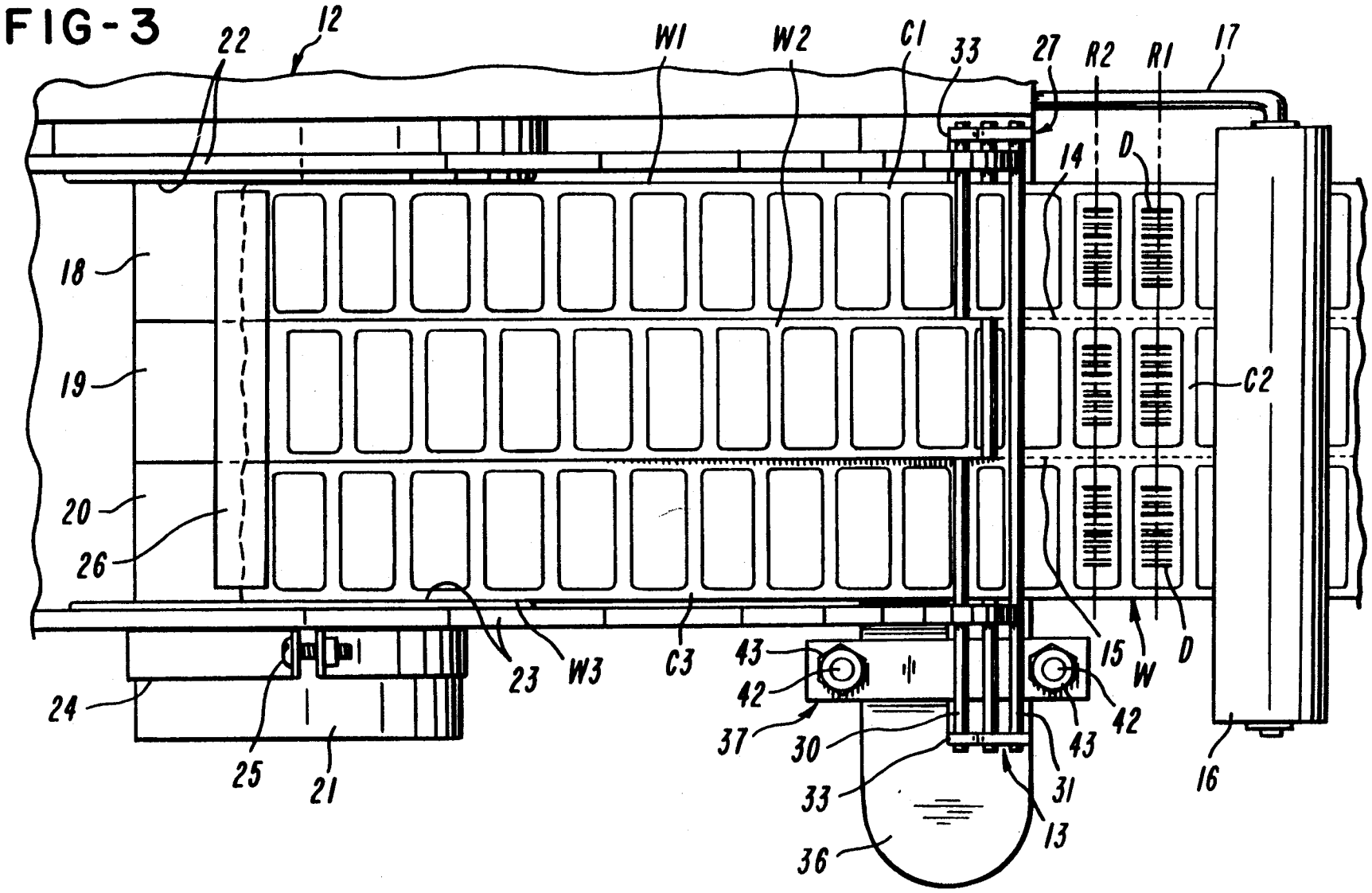
FIG. 3 is a top plan view showing the web portions secured to the cores.

FIGS. 2 and 3 show the manner in which the web portions W1, W2 and W3 are wound into roll form. Cores 18, 19 and 20 are slid onto a hub 21. The one side of the core 18 abuts a side plate 22. The sides of the cores 18, 19 and 20 abut each other. The one side of the core 20 abuts the side plate 23. A clamp 24 on the hub 21 controlled by a screw 25 enables the cores 18, 19 and 20 to be held clamped together frictionally so that they rotate together as a unit. The cores 18, 19 and 20 are driven as a unit as the motor driven hub 21 is rotated in response to the dancer roller 16 having sensed a slack condition in the web W. When the dancer roll 16 is elevated sufficiently due to tautness in the web W, the power to the rewinder motor (not shown) is interrupted and the hub 21 and the cores 18, 19 and 20 cease to be driven. It is apparent that rotation of the hub 21 causes tension in the web W to increase due to the pulling or drawing force exerted by the cores 18, 19 and 20 on the web portions W1, W2 and W3. As shown in FIG. 3, the web portion W1, W2 and W3 are suitably attached to the cores 18, 19 and 20 as by a piece of pressure sensitive tape 26. FIG. 3 shows the initial threading of the web portions at the beginning of a run at which the free terminal ends of the web portions W1, W2 and W3 are attached to cores 18, 19 and 20.

With reference again to FIG. 1, the device 13 is shown to include an upright U-shaped frame 27 and spaced guides 29, 30 and 31. The guides are shown to comprise guide rods preferred rotatably mounted in bearings 32. The bearings 32 are received in spaced arms 33 of the frame 27. The frame 27 also includes a bight 35. The bight 35 is clamped to a base member 36 of the rewinder 12 by spaced clamps generally indicated at 37. The clamps 37 are identical and one is shown in detail in FIG. 2. Each clamp 37 includes a pair of plates 38 and 39 having respective elongate slots 40 and 41. Bolts 42 pass through slots 40 and 41 and threadably receive nuts 43. As shown, the base member 36 has an elastomeric pad 44 which supports the rewinder 12 on the surface S.

With reference to FIG. 1, the device 13 is located at a zone Z downstream of the printer 11 and upstream of the rewinder 12. The web W is shown to pass from beneath the dancer roll 16 to a position behind the guide 31. The web portions W1, W2 and W3 are initially threaded through the device 13 so that the web portions W1 and W3 pass in front of the guide 29 while the web portion W2 passes behind the guide 29. From there the web portions W1 and W3 pass behind the guide 30 and the web W2 passes in front of the guide 30. In FIG. 2 the section line is taken along the line of weakening 15 so only the webs W1 and W2 are shown; the in tact web W contacts the left side of the guide 31, the web portion W2 contacts the left side of the guide 29, the web portion W1 contacts the right side of the guide 29, and the web portion W2 contact the right side of the guide 30. As shown, the tearing of the web W at the lines of weakening 14 and 15 occurs between the guides 31 and 29 but close to the guide 29 when using the preferred form of weakening. The web portions W1 and W3 are confined to move in one curved path or curved plane and the web portion W2 is confined to move in a different curved path or curved plane, as shown in FIGS. 1 and 2. The web portions W1 and W2 undulate in one path and the web portion W2 undulates in another path opposite to the one path. As adjacent pairs of web portions W1 and W2, and W2 and W3 are confined or trained to move progressively in different paths about the guide 29, the web portions W1, W2 and W3 are torn progressively at the lines of weakening 14 and 15. The web portions W1, W2 and W3 are progressively wound onto the respective cores 18, 19 and 20 until the rolls R reach the desired size, whereupon the web portions W1, W2 and W3 are cut downstream of the guide 30, that is, between the guide 30 and the outer wraps of the web portions W1, W2 and W3 on the respective roll R. It should be noted that as the size of the rolls R increase, the inclination of the web portions W1 and W3 downstream of the guide 30 and the inclination of the web portion W2 downstream of the guide 29 become steeper, that is, are closer to vertical. This does not, however, adversely affect the tearing action used to separate the web portions W1, W2 and W3.

When the rolls R have reached predetermined size, the rewinder 12 is stopped, the clamp 24 is loosened from the hub 21 by turning the screw 25, and the clamp 24 and the side plate 23 are slid off the hub 21. The individual cores 18, 19 and 20 with their respective wound web portions W1, W2 and W3 can thus be slid off the hub 21. It is apparent that the printer 11 has been utilized to print simultaneously web portions W1, W2 and W3 for three separate label rolls.

Figure 4:
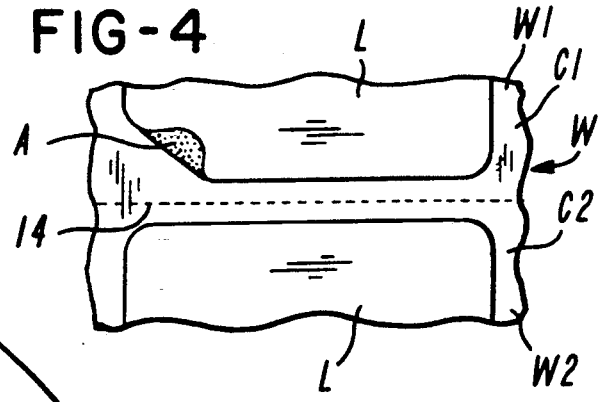
FIG. 4 is a fragmentary view showing a portion of the web with a line of weakening.

FIG. 4 shows a fragmentary portion of the W and its line of weakening 14. The line of weakening 15 is the same as the line of weakening 14. The weakening at 14 and 15 is preferably made by making very short, closely and uniformly spaced knife cuts through the web W. In the illustrated embodiment the knife cuts are 0.008 inch (0.04 mm) long and there are seventy-two knife cuts per inch, that is about seventy-two knife cuts per 2.54 centimeters. However, other suitable weakening of the web to promote intentional tearing can be used such as scoring of the carrier web W, or by punching out material or chad, and the like.

In the embodiment of FIGS. 5 through 9, the same reference characters are used to designate components having the same construction, function and relative location as in the embodiment of FIGS. 1 through 4.

A frame 50 differs from the frame 27 in certain respects, as shown. The frame 50 is generally U-shaped and is secured to the base member 36. The frame 50 has spaced arm 51. A rod **36*a* is secured to the side of the rewinder 12 and passes through holes 36*b* in the arms 51. A fastener 36*c* passing through the base member 36 is threaded into an end portion of the rod 36*b* to clamp the frame 50 to the base member 36. The arms 51 mount a rod 52 which extends parallel to guides 29, 30 and 31**.

Figure 5:
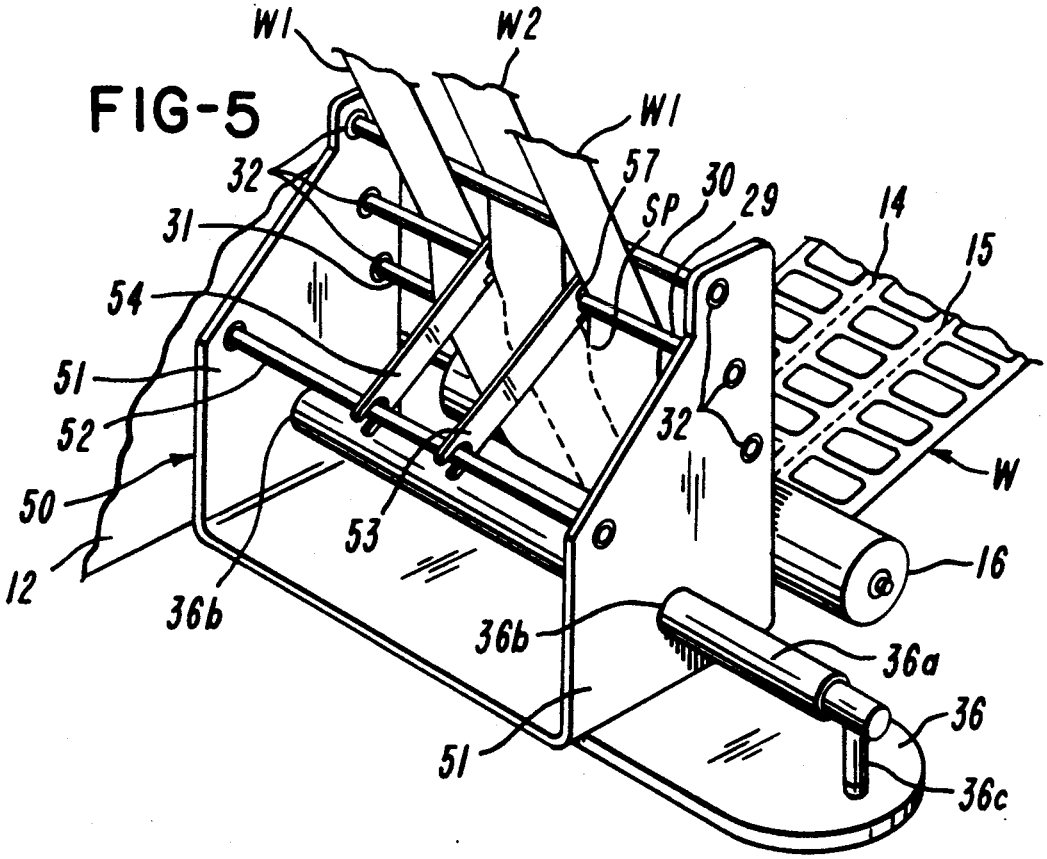
FIG. 5 is a perspective view of a portion of another embodiment of the web handling apparatus of the invention showing the rear side thereof.
Figure 6:
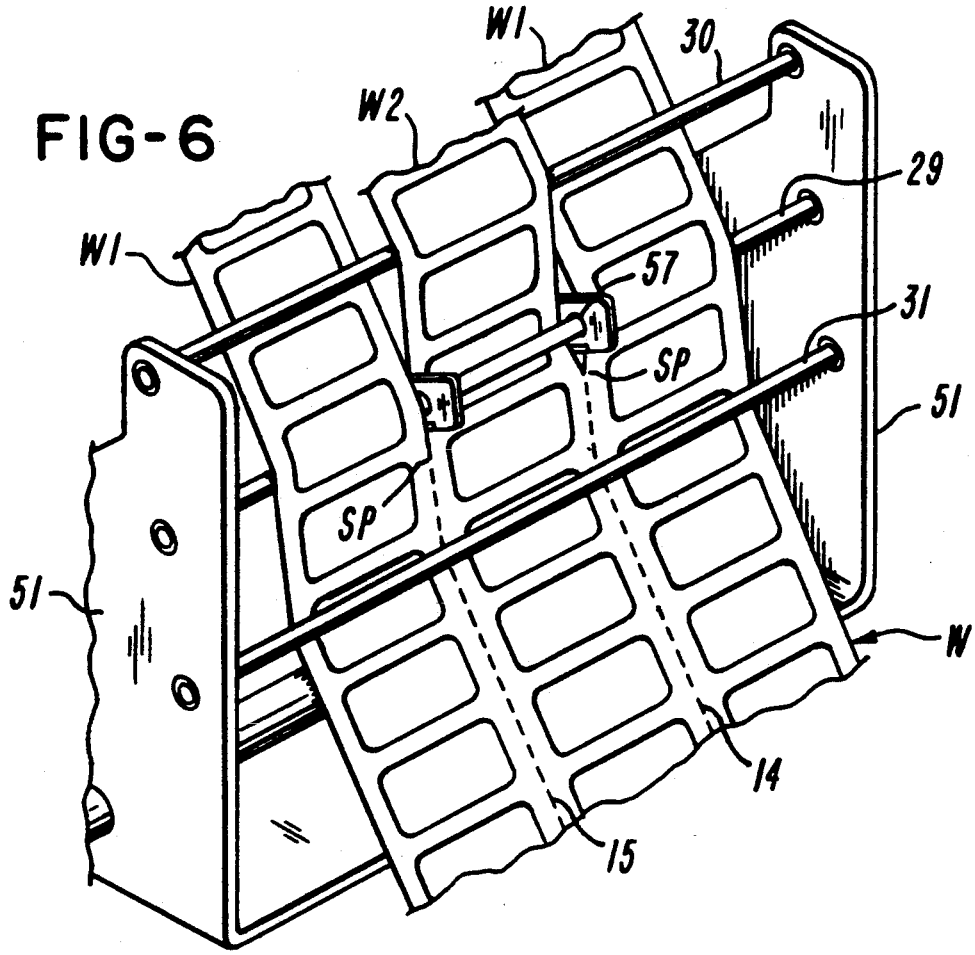
FIG. 6 is a perspective view of the portion of the apparatus shown in FIG. 5, but showing the front side thereof.

Identical knives 53 and 54 are mounted on the guide 29 and on the rod 52. The knife 53 fits between web portions W1 and W2, and the knife 54 fits between another web portion W1 and the web portion W2. The knives 53 and 54 have beveled sides 55 (FIG. 9) which terminate at a flat knife edge 56. In FIGS. 5, 6 and 7, the knife edge 56 is spaced from separation point SP. In normal operation, the web portions W1 and W2 tear apart before the knives 53 and 54 coact with the region of the web W adjacent the separation points SP. However, it can occur that the lines of weakening are not properly cut and the web portions W1 and W2 do not tear apart as desired. This condition is illustrated in FIG. 8 in which the separation point is at the knife edge 56. This can cause tearing and possible rupture of the web portions W1 and/or W2. In the FIG. 8 condition, the knives 53 and 54 assist in separating the web portions W1 and W2 by assisting the tearing or severing at the lines of weakening 15 and 14 respectively. It is noted that the knives 53 and 54 occupy some space between and spreads respective pairs of web portions W1 and W2 and W2 and W1, and this also aids in causing the web portions to separate from each other.

The knives 53 and 54 are only loosely mounted on the guide 29 and on the rod 52. The knives 53 and 54 have oversize holes 57 for receiving the guide 29. Similarly, the knives 53 and 54 have oversize slots 58 for receiving the rod 52. This is best shown in FIGS. 7 and 8. The knives 53 and 54 are free to shift laterally. This is desirable in the event the tracking of the web W between the printer 11 and the rewinder 12 changes.

The identical knives 53 and 54 are preferably specially shaped as best shown in FIG. 9. The faces 55 preferably make a 15° angle with respective sides 59. The flat knife 56 edge preferably is about 0.005 inch (0.127 mm). Although the knife edge 56 could be made sharp, a dull edge, as shown, is preferred.

The embodiment of FIG. 10 is identical to the embodiment of FIGS. 5 through 9, except in FIG. 10 the web portions W1 are threaded over the guide 30 as is the web portion W2.

While a web with three web portions W1, W2 and W3 is illustrated, the invention is useful when the web has two web portions such as W1 and W2 alone, or when the web has more than three web portions.

By way of example, not limitation, in the embodiment of FIGS. 1 through 4 the guides 29, 30 and 31 are disposed in a flat plane. The center line of each guide 30 and 31 is 1.0 inch (2.54 cm) from the center line of the guide 29, and the guides 29, 30 and 31 are about 0.157 inch (4 mm) in diameter.

Although the separation of the web portions W1, W2 and W3 along the lines of weakening 14 and 15 is stated to be accomplished by "tearing", the expression "tearing" is not intended in any limiting sense.

Other embodiments and modifications of the invention will suggest themselves to those skilled in the art, and all such of these as come within the spirit of this invention are included within its scope as best defined by the appended claims.

I claim:

1. Method of handling multi-portion webs, comprising the steps of: providing a longitudinally extending multi-portion web having longitudinal columns and transverse rows of record members, wherein the web has a plurality of longitudinally extending web portions each having a column of the record members and being connected at a longitudinal line of weakening between each adjacent pair of web portions, printing simultaneously on the record members in the transverse rows using a printer, providing a plurality of cores with each core being adapted to have one of the web portions wound thereon, rotating the cores in a rewinder to draw the web with its printed record members and to wind the web portions onto the cores, causing adjacent web portions to move in different planes in a zone downstream of the printer and upstream of the cores to effect tearing and resultant separation of the web portions at each line of weakening as the web portions are drawn, using a knife between adjacent web portions along the line of weakening to assist in separating the web portions when separation fails to occur readily by tearing alone, and removing the cores and the web portions wound thereon from the rewinder.

2. Method of handling multi-portion webs, comprising the steps of: providing a longitudinally extending multi-portion web having longitudinal columns and transverse rows of record members, wherein the web has a plurality of longitudinally extending web portions each having a column of the record members and being connected at a longitudinal line of weakening between each adjacent pair of web portions, printing simultaneously on the record members in the transverse rows using a printer, causing the web portions downstream of the printer to be guided for movement in different planes to effect tearing and resultant separation of the web portions at each line of weakening, using a knife between adjacent web portions along the line of weakening to assist in separating the web portion when separation fails to occur readily by tearing alone, and winding the separated web portions into rolls.

3. Method of handling multi-portion webs, comprising the steps of: providing a longitudinally extending multi-portion web of record members, wherein the web has a plurality of longitudinally extending web portions having record members and being connected at a longitudinal line of weakening between each adjacent pair of web portions, guiding the web portions for movement in different paths to effect tearing and resultant separation of the web portions at each line of weakening, and using a knife between adjacent web portions along the line of weakening to separate the web portion when separation fails to occur readily by tearing alone.

4. Method as defined in claim 3, wherein the web issues from a source device, and allowing the knife or knives to float laterally of the longitudinally extending web issuing from the source device to maintain alignment of the knife or knives with the line or lines of weakening.

5. Method of handling multi-portion web, comprising the steps of: providing a longitudinally extending multi-portion web of record members, wherein the web has a plurality of longitudinally extending web portions having the record members and being connected at a longitudinal line of weakening between each adjacent pair of web portions, causing the web portions to pass along different paths about a guide to effect tearing and resultant separation of the web portions, and using a knife between adjacent web portions along the line of weakening to assist in separating the web portion when separation fails to occur readily by tearing alone.

6. Method of handling multi-portion webs, comprising the steps of: providing a longitudinally extending multi-portion web of record members, wherein the web has a plurality of longitudinally extending web portions having record members and being connected at a longitudinal line of weakening between each adjacent pair of web portions, guiding the web portions for movement in different paths to effect tearing and resultant separation of the web portions at each line of weakening, wherein tearing apart of adjacent web portions occurs at a tear point, providing a knife generally aligned with each respective longitudinal line of weakening, each tear point being spaced from the respective knife when tearing occurs readily, but the region of the web adjacent the tear point moving into contact with the knife to facilitate separation when tearing fails to occur readily.

7. Method as defined in claim 6, including the step of printing on the web portions before separating the web portions.

8. Web handling apparatus for handling a longitudinally extending multi-portion web having transverse rows of record members, wherein the web has a plurality of longitudinally extending web portions each having the record members and being connected at a longitudinal line of weakening between each adjacent pair of web portions, the apparatus comprising: a printer for printing data on the transverse rows of record members, means for tearing apart the printed web portions of the printed web to separate the web into a plurality of web portions, wherein the tearing means includes means for causing the web portions to move in different paths, means for cutting between adjacent web portions along the line or lines of weakening for assisting in separation of the web portions when separation fails to occur readily by tearing alone, and means for winding the separated web portions into rolls.

9. Web handling apparatus for handling a longitudinally extending multi-portion web having web portions connected at a longitudinal line of weakening between each adjacent pair of web portions, the apparatus comprising: means for guiding the web portions, means for drawing the web portions over separate paths to tear adjacent web portions apart to thereby separate the web into web portions, and means for cutting between adjacent web portions along the line or lines of weakening for assisting in separation of the web portions.

10. Web handling apparatus for handling a longitudinal extending multi-portion web having web portions connected at a longitudinal line of weakening between each adjacent pairs of web portions, the apparatus comprising: means for pulling the web, means in the path of the web for causing adjacent web portions to move in different paths to effect tearing apart of adjacent web portions at the line of weakening therebetween, and means for cutting between adjacent web portions along the line or lines of weakening for assisting in separation of the web portions only when separation fails to occur readily by tearing alone.

11. Web handling apparatus for handling a longitudinally extending multi-portion web having web portions connected at a longitudinal line of weakening between each adjacent pair of web portions, the apparatus comprising: means for guiding the web to cause the web portions to move in separate paths to tear adjacent web portions apart at a tear point, and a knife generally aligned with each respective longitudinal line of weakening, each tear point being spaced from the respective knife when tearing occurs readily, but the region of the web adjacent the tear point moving into contact with the knife to facilitate separation when tearing fails to occur readily.

12. Apparatus as defined in claim 11, including means for printing on the web portion before separating the web portions.

13. Web handling apparatus for handling a longitudinally extending multi-part web having web portions connected at a longitudinal line of weakening between each adjacent pair of web portions, the apparatus comprising: a source device for issuing the web, means for guiding the web portions over separate paths to tear adjacent web portions apart to thereby separate the web into web portions, means for cutting between adjacent web portions along the line or lines of weakening for assisting in separation of the web portions when separation fails to occur readily by tearing, and means for enabling the cutting means to float laterally of the longitudinally extending web issuing from the source device to maintain alignment of the cutting means with the line or lines of weakening.

14. Web handling apparatus for handling a longitudinally extending multi-portion web having web portions connected at a longitudinal line of weakening between each adjacent pair of web portions, the apparatus comprising: means for guiding the web portions, means for drawing the web portions over separate paths to tear adjacent web portions apart to thereby separate the web into web portions, means for cutting between adjacent web portions along the line or lines of weakening for assisting in separation of the web portions, and means for enabling the cutting means to float laterally to maintain alignment of the cutting means with the line or lines of weakening.

15. Web handling apparatus for handling a longitudinally extending multi-part web having web portions connected at a longitudinal line of weakening between each adjacent pair of web portions, the apparatus comprising: a source device for issuing the web, means for printing on the web portions, means for guiding the printed web portions over separate paths to tear adjacent web portions apart to thereby separate the web into web portions, means for cutting between adjacent web portions along the line or lines of weakening for assisting in separation of the web portions when separation fails to occur readily by tearing, and means for enabling the cutting means to float laterally of the longitudinally extending web issuing from the source device to maintain alignment of the cutting means with the line or lines of weakening.

16. Web handling apparatus for handling a longitudinally extending multi-portion web having web portions connected at a longitudinal line of weakening between each adjacent pair of web portions, the apparatus comprising: means for printing on the web portions, means for guiding the printed web portions, means for drawing the web portions over separate paths to tear adjacent web portions apart to thereby separate the web into web portions, and means for cutting between adjacent web portions along the line or lines of weakening for assisting in separation of the web portions.

17. Web handling apparatus for handling a longitudinal extending multi-portion web having web portions connected at a longitudinal line of weakening between each adjacent pairs of web portions, the apparatus comprising: means for printing on the web portions, means for pulling the web, means in the path of the web for causing adjacent printed web portions to move in different paths to effect tearing apart of adjacent web portions at the line of weakening therebetween, and means for cutting between adjacent web portions along the line or lines of weakening for assisting in separation of the web portions only when separation fails to occur readily by tearing alone.

18. Method of handling a longitudinally extending multi-portion web having web portions connected at a longitudinally line of weakening between each adjacent pair of web portions, comprising the steps of: guiding the web portions, drawing the web portions over separate paths to tear adjacent web portions to thereby separate adjacent web portions into web portions, and cutting between adjacent web portions along the lines of weakening for assisting in separation of the web portions.

19. Method of handling a longitudinally extending multi-portion web having web portions connected at a longitudinally line of weakening between each adjacent pair of web portions, comprising the steps of: printing on the web portions guiding the printed web portions, drawing the web portions over separate paths to tear adjacent web portions to thereby separate adjacent web portions into web portions, and cutting between adjacent web portions along the lines of weakening for assisting in separation of the web portions.

20. Method of handling a multi-portion web, comprising the steps of: providing a longitudinally extending multi-portion web of record members, wherein the web has a plurality of longitudinally extending web portions having the record members and there is a connection at a longitudinal line of weakening between each adjacent pair of web portions, providing a plurality of guides, causing adjacent web portions to be threaded in different paths about the guides to effect tearing and resultant separation of the web portions, wherein the guides comprise first, second and third spaced-apart guide rods, wherein the in tact web passes about the third guide rod, thereafter adjacent web portions pass about different sides of the first guide rod, and thereafter adjacent web portions pass about different sides of the second guide rod so that adjacent web portions pass through oppositely undulating paths.

* * * * *

UNITED STATES PATENT AND TRADEMARK OFFICE

CERTIFICATE OF CORRECTION

PATENT NO. : 5,144,891

DATED : September 8, 1992

INVENTOR(S) : Thomas G. McKenna

It is certified that error appears in the above-identified patent and that said Letters Patent is hereby corrected as shown below: Title page, item [56], References Cited, "3,783,783 1/1974 Hamisch, Sr." has been omitted. Column 4, line 41, "arm" should be --arms--. Column 8, line 63, after "portions" (first occurrence) there should be a comma.

Signed and Sealed this

Nineteenth Day of October, 1993

*Attest:*

*Attesting Officer*

BRUCE LEHMAN

*Commissioner of Patents and Trademarks*